United States Patent [19]

Etheridge

[11] Patent Number: 4,835,365

[45] Date of Patent: May 30, 1989

[54] DE-IONIZED FLUID HEATER AND CONTROL SYSTEM

[76] Inventor: David R. Etheridge, 1733 Hiawatha Dr., Glendora, Calif. 91208

[21] Appl. No.: 35,058

[22] Filed: Apr. 6, 1987

Related U.S. Application Data

[63] Continuation-in-part of Ser. No. 913,505, Sep. 29, 1986, Pat. No. 4,756,781.

[51] Int. Cl.[4] ..... H05B 1/02; H05B 3/82; F24H 1/10; F24H 9/20

[52] U.S. Cl. ..... 219/298; 200/61.52; 219/306; 219/307; 219/308; 219/309; 219/331; 219/333; 219/338; 219/374; 219/381

[58] Field of Search ..... 219/296–299, 219/302–309, 280–282, 374–376, 381–382, 335–338, 331, 328; 200/61.52

[56] References Cited

U.S. PATENT DOCUMENTS

| | | | |
|---|---|---|---|
| 1,196,487 | 8/1916 | Simon | 219/309 |
| 1,437,046 | 11/1922 | Dominguez | 219/299 |
| 1,766,068 | 6/1930 | Delannoy | 219/305 |
| 3,054,710 | 9/1962 | Nixon . | |
| 3,415,287 | 12/1968 | Heslop et al. . | |
| 3,452,312 | 6/1969 | Bauer | 200/61.52 X |
| 4,158,126 | 6/1979 | Seitz | 219/328 X |
| 4,319,940 | 3/1982 | Arroyo et al. . | |
| 4,368,147 | 1/1982 | Dytch et al. | 219/306 X |
| 4,461,347 | 7/1984 | Layton | 219/306 X |
| 4,502,214 | 3/1985 | Miles et al. . | |
| 4,567,350 | 1/1986 | Todd | 219/308 X |
| 4,617,449 | 10/1986 | Weitzel et al. . | |
| 4,645,907 | 2/1987 | Salton | 219/309 |
| 4,713,525 | 12/1987 | Eastep | 219/308 |
| 4,756,781 | 7/1988 | Etheridge | 219/322 X |

FOREIGN PATENT DOCUMENTS

| | | | |
|---|---|---|---|
| 209116 | 6/1957 | Australia | 219/306 |
| 209867 | 1/1987 | European Pat. Off. | 219/306 |
| 1806722 | 5/1970 | Fed. Rep. of Germany | 219/307 |
| 2400478 | 1/1975 | Fed. Rep. of Germany | 219/308 |
| 3306807 | 8/1984 | Fed. Rep. of Germany | 219/306 |
| 115931 | 7/1984 | Japan | 219/306 |
| 158935 | 9/1984 | Japan | 219/282 |
| 122453 | 6/1986 | Japan | 219/306 |
| 638808 | 12/1978 | U.S.S.R. | 219/306 |
| 358681 | of 0000 | United Kingdom | 219/307 |
| 122288 | 1/1919 | United Kingdom | 219/306 |
| 422803 | 1/1935 | United Kingdom | 219/307 |
| 2151050 | 7/1985 | United Kingdom | 219/306 |

OTHER PUBLICATIONS

"Instant Hot Water Flows From Cold-Water Pipe", Popular Science, Jul. 1961, pp. 44–46 and 182.

*Primary Examiner*—Anthony Bartis
*Attorney, Agent, or Firm*—Kelly, Bauersfeld & Lowry

[57] ABSTRACT

A heating system for non-contaminatingly electrically heating a de-ionized fluid includes a master heater unit having a heater body with an inlet an outlet at one end, a tube which channels entering fluid centrally through the body to a point distally spaced from the outlet, turbulence creating plenum plates on the tube and a resistance heating element enclosed in an inert corrosion resistant PFA jacket and helically wound about the tube. The outlet of the master unit is connected to the inlet of a similar slave fluid heater unit. The heater units are each grounded by a ground wire having a tantalum or platinum tip exposed to the fluid. The heating elements are controlled by a solid state relay responsive to a minimum fluid flow rate sensor, high temperature limit controller, a fluid level controller and a tip-over sensor. A microprocessor compares the fluid flow rate through the system with the system outlet fluid temperature, and controls the relay to limit the maximum temperature of the fluid exiting the system to a pre-set value.

21 Claims, 3 Drawing Sheets

FIG. 8
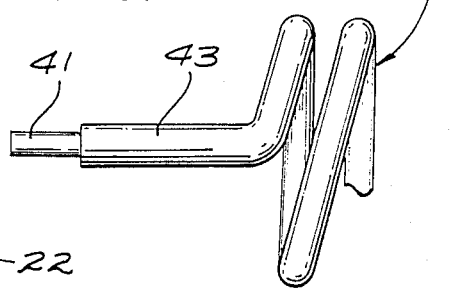
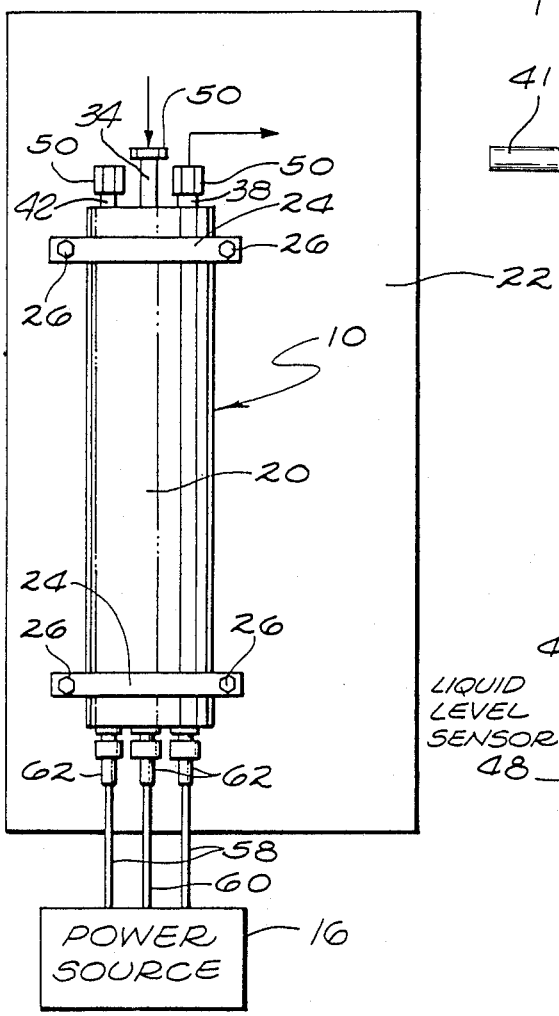
FIG. 1
FIG. 2
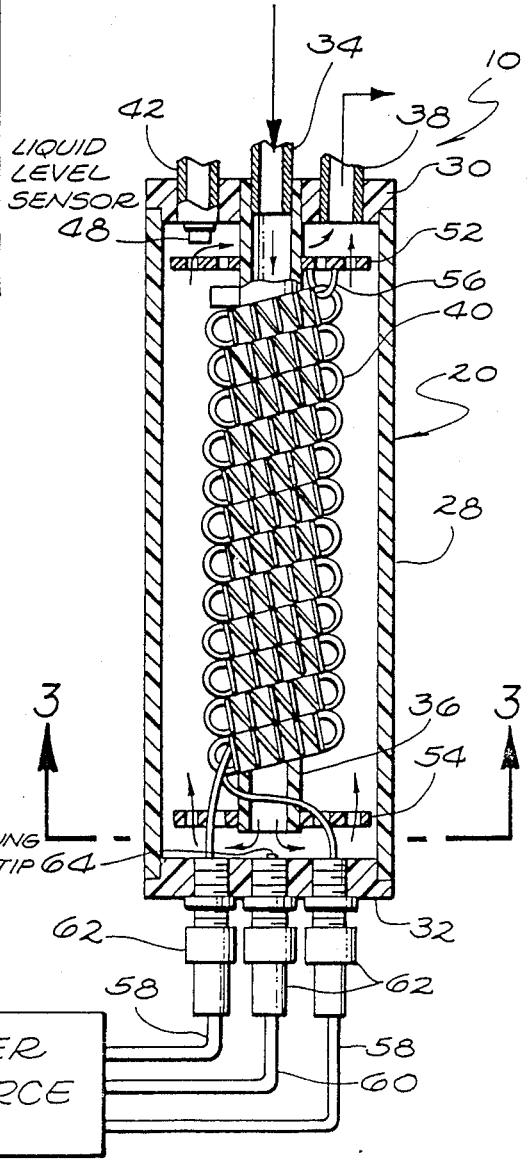
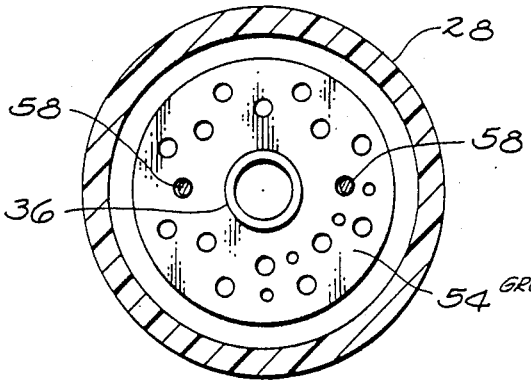
FIG. 3

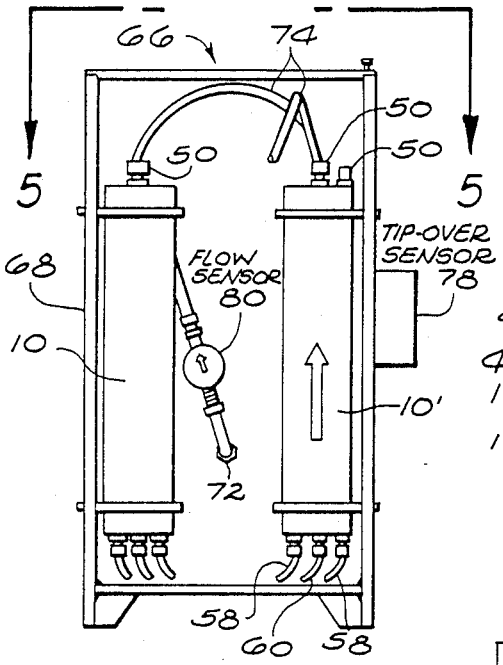
FIG. 4
FIG. 5
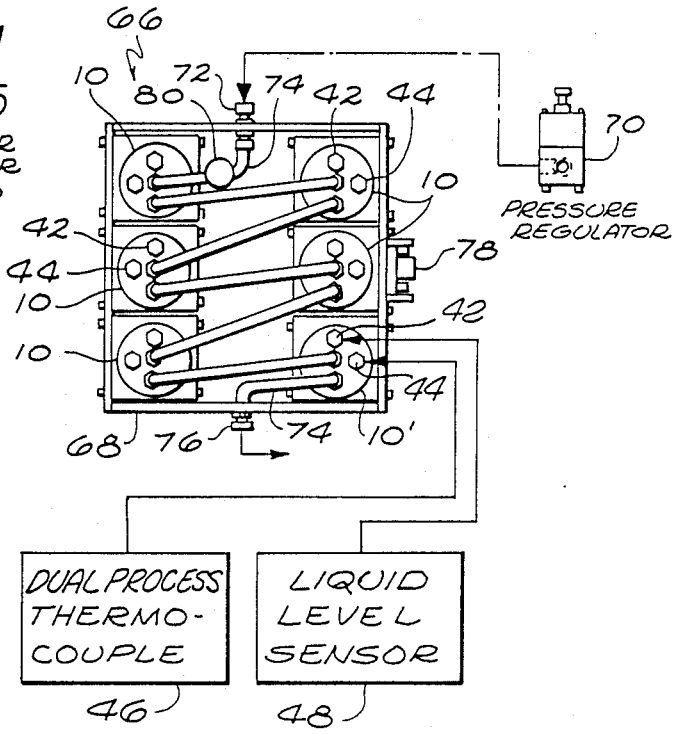
FIG. 6
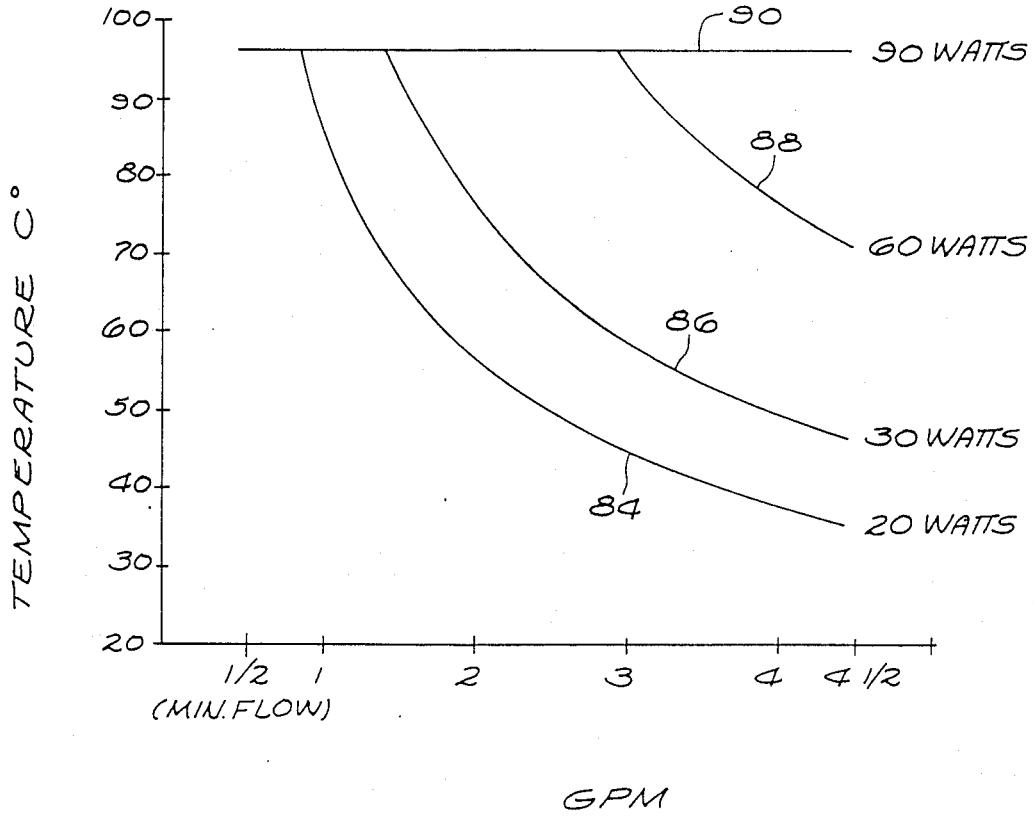

DE-IONIZED FLUID HEATER AND CONTROL SYSTEM

RELATED APPLICATION

This application is a continuation-in-part of U.S. patent application Ser. No. 06/913,505, filed Sept. 29, 1986 issued July 12, 1988 as U.S. Pat. No. 4,756,781 and entitled NON-CONTAMINATING FLUID HEATER AND METHOD CONNECTING THE HEATING ELEMENT TO A POWER SOURCE.

BACKGROUND OF THE INVENTION

This invention relates generally to contamination-free fluid heating systems, and, more specifically to a non-contaminating fluid heater and a safety system for limiting the maximum fluid temperature within the heater and for preventing heater operation under defined circumstances.

With the advent of microchip technology, there has developed a need for systems which utilize contaminant-free fluids. For example, during the manufacturing of computer microchips, acids may be used for etching the microchips and water may be used for rinsing. Because of the small scale of today's microcircuits and the high manufacturing tolerances required, virtually any impurity in the etching or rinsing fluid can result in defective parts and wasted resources.

To provide the necessary high-purity fluid for use in such systems, filtering processes are employed to remove virtually all contaminants and, effectively, de-ionize the fluid. The systems are further designed to prevent contact between the contaminant-free fluid and any substance which would tend to corrode in the presence of the fluid, causing impurities to be reintroduced.

Many systems require the contaminant-free fluid to be heated above ambient temperatures to meet required design and manufacturing parameters. Heater manufacturers have sought to design acceptable devices which are thermally efficient, responsive to fluid flow changes, and capable of long life. Although most plastic materials tend to be good thermal insulators and therefore seemingly inappropriate for some uses in heating systems, most modern heaters for use in microchip manufacturing systems must employ plastics to shield the contaminant-free fluid from the metallic heating element, lead wires and the like.

Because thermally insulative material must be used to shield the metallic portion of the heating element from the contaminant-free fluid, much more power is utilized by the heater than would be required in the absence of the insulative shielding. Therefore, the heating coil must usually remain completely submerged within the heated fluid or it will overheat and burn. Further, the electrical connection between the lead wires and the heating element is usually submerged into the heated fluid and subjected to its sometimes corrosive nature.

Attempts have been made to provide a seal about the electrical connection between the lead wires from the power source and the heating element, to protect that connection from the heated fluid and to prevent any leaching of contaminants from the wires into the fluid. The failure to adequately protect this electrical connection has been a problem area for heater manufacturers and users. More specifically, imperfections in sealing techniques often result in failure of the system (exposure of the metallic portion of the heating element or lead wire), requiring repurification of the fluid and replacement of the heater. The useful life of many prior heaters and heating systems is determined primarily by the lifetime of the environmental sealing means surrounding this electrical connection.

An acceptable seal for the electrical connection between the lead wires from the power source to the heating element, which overcomes the limitations and drawbacks of the prior art, is shown and described in my co-pending U.S. patent application Ser. No. 06/913,505, filed Sept. 29, 1986, now U.S. Pat. No. 4,756,781.

Heaters and heating systems for use in microchip manufacturing processes are inherently expensive due to the precise nature of their construction and the materials required for such. It is thus very important that extraordinary measures be taken to ensure proper operation of the non-contaminating heating system, including measures to prevent overheating of the fluid and the heating coils.

Accordingly, there has been a need for a novel non-contaminating fluid heater capable of use with a broad spectrum of fluids, in a variety of operational configurations and within a broad range of temperatures. In this regard, there has been a need for a heating system and associated heater hardware which lends itself readily to a variety of power/flow configurations to accommodate varying needs of prospective users. Additionally, there exists a need for non-contaminating fluid heating systems which can efficiently and economically heat and maintain the fluid passing therethrough at a desired temperature. Further, a fluid heater is needed which is durable and capable of long, sustained use in harsh environments. Moreover, a fluid heater and control system is needed for preventing damage to the heater components and for ensuring that the fluid will be heated only to temperatures within acceptable limits. The present invention fulfills these needs and provides other related advantages.

SUMMARY OF THE INVENTION

The present invention resides in an improved non-contaminating fluid heater and safety system for limiting the maximum fluid temperature within the heater and for preventing heater operation under defined circumstances. The fluid heater comprises, generally, a heater body having a fluid inlet generally adjacent a fluid outlet, and means for channelling the fluid received into the heater body through the inlet to a point substantially distally spaced from the fluid outlet. A resistance heating element is wound about the channelling means, and connected to lead wires from a power source passing through the heater body.

In one preferred form, the heater body is generally cylindrical in shape and configured so the inlet and outlet pass through its upper end. The fluid channelling means comprises a tube extending from the inlet generally through the center of the heater body and terminating adjacent the lower end. At least one plenum plate circumscribes the lower end of the central tube to increase turbulence of the fluid on its passage from the outlet end of the tube to the heater body outlet. The heating element is helically would substantially the length of the central tube, and is connected to lead wires passing through the heater body.

Two or more of these fluid heaters can be serially connected to one another to form a fluid heating system. In such systems, the last heating unit in the series is typically referred to as the "master heating unit", and its fluid outlet generally communicates directly with a system fluid outlet. This master heater unit is further typically equipped with a fluid level sensor for detecting a specified fluid level within the master heater body, and a thermocouple for detecting the temperature of the fluid as it exits the master heated fluid outlet.

The other fluid heaters serially connected to the master heater are referred to as "slave heaters". The fluid inlet to the initial slave heater in the system communicates directly with a system fluid inlet. The pressure of fluid supplied to the system fluid inlet is controlled by a pressure regulator, and a flow sensor is provided between the system fluid inlet and the initial slave heater inlet for detecting the flow of fluid through the heating system. Additional thermocouples are placed alongside the lead wires and extend into each heater unit to lie alongside each heating element for measuring the temperature thereof. Moreover, the master and slave heater units are placed within a housing equipped with a tip-over sensor and switch.

A control and safety system for such heating units and heating systems includes on/off switch means responsive to conditions within and affecting the fluid heater, which switch means is capable of interrupting the power supply from the power source to the fluid heater. The control and safety system further comprises voltage control means for adjustably and selectively controlling the voltage from the power source to the fluid heaters. More specifically, the voltage control means includes microprocessor means which receives data input on the flow of fluid into the heating system and the temperature of the fluid exiting the heating system. Further, a voltage control switch is provided which is responsive to input from the microprocessor means, and which controls the level of voltage available from the power source that is fed to the heating system. The voltage control means effectively limits the maximum temperature of the fluid exiting the heater to a pre-set range.

The voltage control means additionally includes an adjustable temperature controller which receives input from the thermocouple detecting the temperature of the fluid exiting the heater outlet, and a flow signal conditioner which receives input from the fluid flow sensor. The microprocessor includes a signal mixer which receives signals from the adjustable temperature controller and the flow signal conditioner. This signal mixer puts out a signal of its own which is received by a signal converter and amplifier which, in turn, provides input signals to the voltage control switch.

The on/off switch means includes a minimum flow interlock activated by failure of the fluid flow sensor to detect a minimum fluid flow through the heating system, a minimum liquid level relay switch which is activated by failure of the level sensor to detect an adequate fluid level within the master heater unit, and a process over-temperature relay switch which is activated if the fluid exiting the master heater outlet exceeds a pre-set safety limit. The tip-over switch attached to the housing for the system is also provided a relay forming a portion of the on/off switch means, which relay interrupts power to the heating system if the housing is upset. Finally, the on/off switch means includes a high-temperature limit relay which cuts off power to the heating system if any of the thermocouples placed adjacent the heating elements sense an over-temperature condition at those locations.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 is an external and somewhat schematic view of a fluid heater and related components embodying portions of the present invention;

FIG. 2 is an enlarged, elevational and partially sectional view of the fluid heater of FIG. 1, illustrating the configuration of a resistance heating element within the heater body and the manner in which lead wires pass through the heater body for connection with the heater element;

FIG. 3 is an enlarged, partially sectional view taken generally along the line 3—3 of FIG. 2, illustrating the configuration of the plenum plate about the central tube within the heater body;

FIG. 4 is an external and somewhat schematic view of a fluid system embodying the present invention, illustrating several of the fluid heaters of FIG. 1 attached serially to one another and situated within a housing;

FIG. 5 is a schematic plan view taken generally along the line 5—5 of FIG. 4, illustrating the manner in which individual fluid heaters can be attached to one another serially to form a fluid heating system, and further showing the location of a master fluid heater, having a process thermocouple and level sensor attached thereto, in relation to the slave fluid heaters;

FIG. 6 is an exemplary chart showing temperature versus flow rate for several water heating systems producing a heating power output of, respectively, 20, 30, 60 and 90 watts;

FIG. 8 is an enlarged fragmented elevational view of an end of the resistance heating element utilized in the fluid heater of FIG. 1, illustrating an extruded jacket of corrosion-resistant material applied to a heating coil.

DETAILED DESCRIPTION OF THE PREFERRED EMBODIMENT

Figure 7:
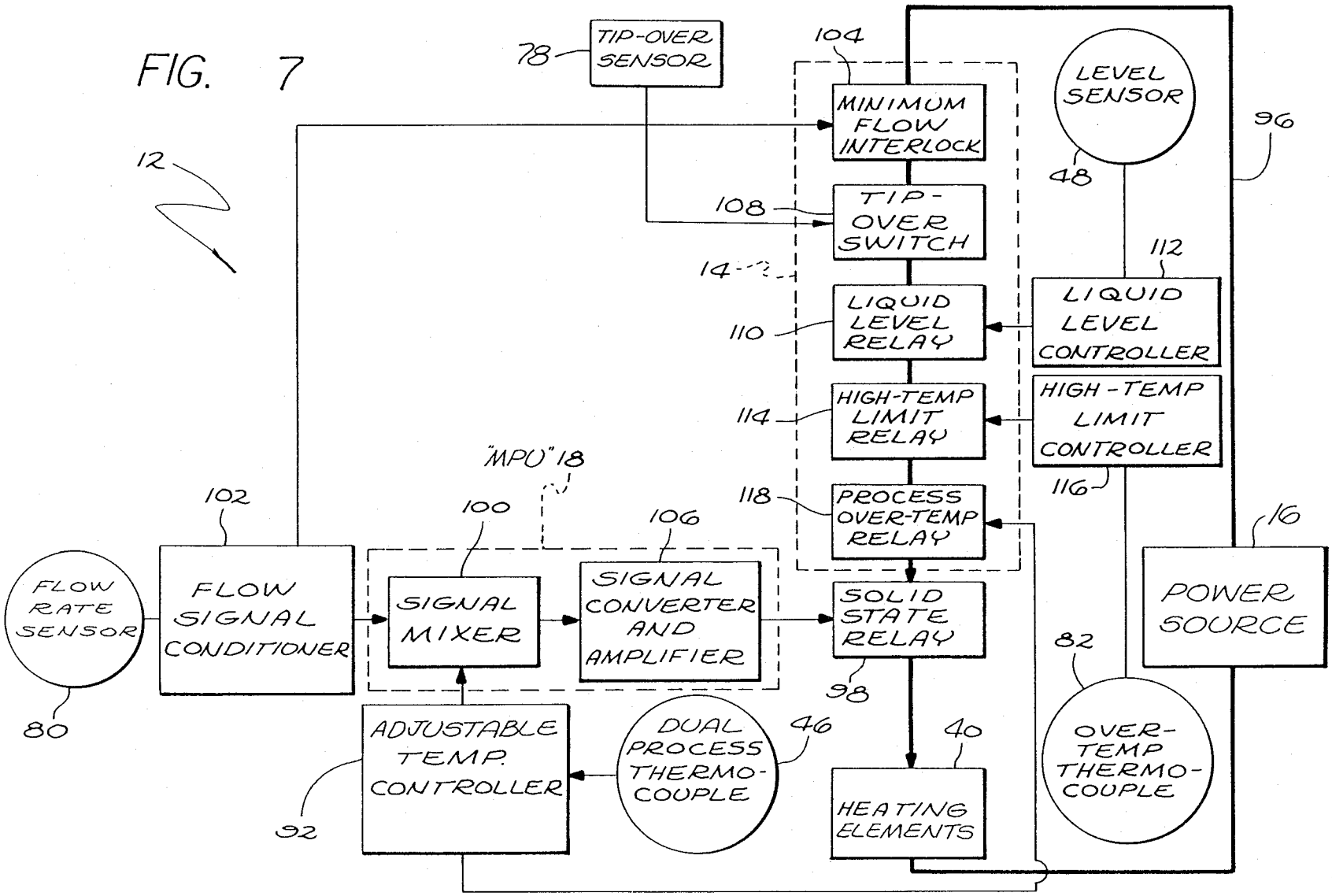
FIG. 7 is a diagram illustrating the components and logic of the control and safety system of the present invention.

As shown in the drawings for purposes of illustration, the present invention is concerned with an improved fluid heater, generally designated in FIGS. 1 and 2 by the reference number 10, and a control and safety system for the fluid heater, which system is designated in FIG. 7 by the reference number 12. The improved fluid heater 10 is intended for use with contaminant-free fluids ranging in temperature from cryogenic applications to systems for heating fluids in excess of 200° C. The control and safety system 12 is designed to protect the fluid heater 10 components and prevent heating of the fluid to a temperature above a pre-set limit. In particular, the control and safety system 12 includes on/off switch means 14 which ensures specified conditions are met before an electromotive force from an externally situated power source 16 is connected to the fluid heater 10, and microprocessor means 18 which compares the fluid flow through the heater 10 with the temperature of the fluid exiting the heater to prevent heating of the fluid above the pre-set limit.

In accordance with the present invention, and as illustrated best in FIGS. 1 and 2, the fluid heater 10 includes heater body 20 mounted to a board 22 by means of suitable brackets 24 and bolts 26. The heater body 20 is constructed of a cylindrical outer PVDF (Polyvinylidene Fluoride) encasement 28 having a PVDF top end plate 30 fused to its upper end, and a similar PVDF bottom end plate 32 fused to its bottom end.

The top end plate 30 is provided several tubes which form passageways allowing access to the interior of the heater body 20. An inlet tube 34 channels inlet fluids through the top end plate 30 into a central tube 36 extending downwardly through the center of the heater body 20 to a discharge point near the bottom end plate 32. An outlet tube 38 is situated generally adjacent the inlet tube 34 to maximize the fluid flow travel path through the heater body 20 for maximum fluid exposure to a resistance heating element 40. A third access tube 42 and a fourth access tube 44 (see FIG. 5) facilitate placement of any one of several desirable sensors utilized for controlling power input to the resistance heating element 40. For example, these third and fourth 42 and 44 can be utilized to place a standard dual element process thermocouple 46 and a fluid level sensor 48 (shown schematically in FIG. 7) into the heated fluid. Notwithstanding the particular function of the various access tubes 34, 38, 42 and 44, each is equipped with a suitable connector 50 which permits attachment to other tubes or apparatus while preventing fluid leakage.

The resistance heating element 40 is helically wound about the central tube 36 substantially its entire length, and is positioned between a pair of PVDF plenum plates 52 and 54. As illustrated in FIG. 8, the resistance heating element 40 comprises a solid core resistance wire 41, and an extruded jacket 43 of PFA teflon which is applied to the wire 41 in a manner insuring that the jacket is pulled down tightly onto the wire to maximize heat transfer. Voids or air bubbles between the resistance wire 41 and the jacket 43 could cause hot spots and lead to overtemperature failure of the protective jacket 43. A clean wire 41 with minimum pits is preferred. The plenum plates 52 and 54 circumscribe, respectively, upper and lower portions of the central tube 36 to help ensure substantially uniform flow of fluid past the resistance heating element 40 as it flows from the lower end of the central tube 36 upwardly toward the outlet tube 38. A PVDF anchor 56 provides a means of attaching the upper portion of the resistance heating element 40 to the upper plenum plate 52.

Like the top end plate 30, the bottom end plate 32 is provided several passageways which, as shown in the drawings, are provided to permit insertion of two lead wires 58 and a ground wire 60 into the heater body 20. Although all three of these wires are shown in FIG. 1 as coming from the power source 16, the ground wire 60, of course, could be grounded in any suitable manner. To permit passage of these wires 58 and 60 through the bottom end plate 32 without causing any fluid leakage therethrough, a connector assembly 62 is provided for each wire. A suitable connector assembly 62 is fully shown and described in my co-pending U.S. patent application entitled NON-CONTAMINATING FLUID HEATER AND METHOD OF CONNECTING THE HEATING ELEMENT TO A POWER SOURCE, filed Sept. 29, 1986 and assigned Ser. No. 06/913,505, now U.S. Pat. No. 4,756,781. The entire contents of that application are incorporated herein by reference.

The connector assembly 62, like the other components of the fluid heater 10, is constructed of materials which are inert and corrosion-resistant to the fluid being heated. In this manner, the contaminant-free nature of the fluid can be reliably maintained. The lead wires 58, the ground wire 60, the resistance heating element 40, the process thermocouple 46 and the fluid level sensor 48 are no exception. They too must only present fluid contacting surfaces which are inert and corrosion-resistant to the fluid being heated. In this regard, the wires 58 and 60 and the resistance heating element 40 are preferably jacketed with at least one layer of PFA (Perfluoroalkoxy) Teflon material. The connections between the lead wires 58 and the resistance heating element 40 must further be encased within an environmental seal capable of resisting the corrosive nature of the fluid being heated. This environmental seal is treated in detail in my U.S. Pat. No. 4,756,781.

With regard to the ground wire 60, it is sometimes necessary to place a metallic component in contact with the heated fluid for safety purposes. To satisfy this requirement, preferably only a tantalum tip 64 is exposed to the heated fluid. It has been found that such material is inert to most heated fluids, with the exception of hydrofluoric solutions. In such cases, a platinum tip is utilized for grounding the fluid within the fluid heater 10.

Reference now being made to FIGS. 4 and 5, a plurality of the fluid heaters 10 can be serially connected to one another to form a heating system 66. An exemplary heating system 66, including five slave fluid heaters 10 and a master fluid heater 10', is illustrated in an assembled configuration within a PVDF housing 68. The housing 68 functions in the same manner as the board 22 illustrated in FIG. 1, to simply provide secure attachment means for the fluid heaters 10.

A pressure regulator 70 typically controls the feed pressure of fluid entering the heating system 66. The inlet 72 of the heating system 66 is defined by a connector similar to the connector 50 on top of the heating units 10. A section of FEP (Perfluoroethylenepropylene) tubing 74 directs the fluid from the system inlet 72 to the inlet tube 34 of a first slave heater 10. Additional sections of tubing 74 are provided for serially connecting the outlet tube 38 of each slave heater 10 with the inlet tube 34 of a next subsequent fluid heater in the series. A typical arrangement is illustrated in FIG. 5. The last fluid heater in the series is referred to as the master fluid heater 10', primarily because the process thermocouple 46 and the fluid level sensor 48 are positioned through the third and fourth access tubes 42 and 44 on this master fluid heater 10'. On the slave fluid heaters 10, the third and fourth access tubes 42 and 44 are typically plugged. A final segment of FEP tubing 74 extends from the outlet tube 38 on the master fluid heater 10', to a connector located on the housing 68, which connector defines a heating system outlet 76.

The level sensor 48 utilized in connection with the master fluid heater 10' is preferably similar to Model 12-502A, manufactured by GENELCO of Dallas, Tex., and is positioned to detect fluid within the heater body 20 near the top end plate 30. The process thermocouple 46 is positioned near the outlet tube 38 on the master fluid heater 10' to measure the temperature of the fluid exiting the heating system 66. The importance of the level sensor 48 and the process thermocouple 46 will be described more fully in connection with the control and safety system 12 illustrated in FIG. 7.

In addition to the foregoing, a tip-over sensor 78 is positioned on the housing 68, and a fluid flow sensor 80 is provided to measure the fluid flow from the system inlet 72 to the first slave heater unit 10. It is preferred that the tip-over sensor be similar to Model No. T03, manufactured by DURAKOOL of Elkhart, Ind., and that the fluid flow sensor 80 be similar to Model No. MICET MK508, manufactured by SIGNET SCIENTIFIC of El Monte, Calif. Moreover, it is often important to measure the temperature of the resistance heating elements 40 within each fluid heater 10 and 10', and thus an over-temperature thermocouple 82 is preferably positioned adjacent the upper end of the resistance heating element within the environmental seal surrounding the connection between the lead wire 58 and the resistance heating element 40. A suitable method of positioning the over-temperature thermocouple 82 is illustrated and described in my U.S. Pat. No. 4,756,781.

A known procedure for controlling the output fluid temperature is to provide an adjustable temperature controller which receives signals from a process thermocouple similar to the thermocouple 46, and based on that input controls a variable voltage switch which regulates the voltage to the resistance heating elements 40. Thus, if it is desired to heat de-ionized water to 80° C., that temperature would be set on the adjustable temperature controller and, theoretically, the power output of the resistance heating elements 40 would be regulated based on the temperature of the fluid flowing through the system outlet. It should be apparent that in the absence of a mechanical failure by the process thermocouple, the temperature control or the variable voltage switch, the fluid can be maintained at the desired temperature notwithstanding slight changes in fluid flow. However, if one of these components malfunctions and fluid flow is reduced, the temperature of the heated fluid can raise dramatically and disasterously to a point which can cause damage to the heating system itself or to units or components receiving the heated fluid downstream.

To illustrate this point, reference is made to the graph of FIG. 6, wherein fluid temperature is set forth on the vertical, "Y", axis, and fluid flow in gallons per minute is set forth on the horizontal, "X", axis. Each curved line 84, 86, 88 and 90 represents an exemplary heating system 66 similar to that illustrated in FIGS. 4 and 5, with differences in power output. Each of the curves 84 through 90 illustrate the maximum temperature to which fluid can be heated by the respective heating system 66 with relation to fluid flow through the system. For example, with reference to curve 86 (the thirty watt system), the maximum fluid temperature attainable at a flow rate of three gallons per minute is approximately 57° C., and at a flow rate of four gallons per minute the maximum fluid temperature attainable is approximately 47° C. As the flow rate decreases, the maximum attainable fluid temperature increases.

The horizontal line 90 for the ninety watt system represents an arbitrary, pre-set maximum safe temperature for the exemplary heating system 66 when used for heating de-ionized water. The line 90 also shows that a ninety watt system is capable of heating water to any desired temperature up to the pre-set 96° C. limit, for the flow range shown. It has been found that de-ionized water heated above approximately 96° C. begins to vaporize and cause damage to the heating system components. The control and safety system 12 illustrated in FIG. 7 provides a novel means for limiting the maximum temperature attainable by the heating system 66, and yet desirably permits a temperature controller 92 to be set below the maximum temperatures attainable by a particular system and maintain the temperature of the system outlet fluid at a less than maximum level in the known manner discussed briefly above.

With reference to FIG. 7, the power source 16 delivers a specified voltage (typically 208 volts or 480 volts) to the resistant elements 40 of the heating system 66. A thick line loop 96 illustrates the primary voltage flow path to the heating elements 40 of fluid heaters 10 and 10'. The on/off switch means 14 comprises a of relays or switches interposed between the power source 16 and the heaters heating elements of 10 and 10', which switches and relays are responsive to conditions within and affecting the fluid heaters. The on/off switch means 14 is capable of interrupting the power supply from the power source 16 to the fluid heaters 10 and 10'.

The microprocessor means 18 is the primary component of a voltage control apparatus for adjustably and selectively controlling the voltage from the power source 16 to the fluid heaters 10 and 10'. The microprocessor means 18 compares the flow of fluid into the heating system 66 with the temperature of the fluid exiting the heating system. A voltage control switch, shown as a solid state relay 98, is responsive to input from the microprocessor means 18, and it is this variable voltage switch which controls level of voltage available from the power source 16 that is fed to the resistance heating elements 40 within the fluid heaters 10 and 10'. The voltage control apparatus limits the maximum temperature of the fluid exiting the heating system 66.

A preferred temperature controller 92 is Model 6000, manufactured by ATHENA CONTROLS, INC. of Plymouth Meeting, Pa. The solid state relay 98 is preferably similar to Model SSD4875, manufactured by MASTER ELECTRONIC CONTROLS of Los Angeles, Calif.

The adjustable temperature controller 92 receives input from the process thermocouple 46 which, as discussed previously, measures the temperature of the fluid exiting the master fluid heater 10' outlet tube 38. Based on this input, the temperature controller 92 sends a 4 to 20 mA signal proportional to temperature deviation to a signal mixer 100, which signal mixer forms a portion of the microprocessor means 18. When the flow sensor 80 detects flow, it sends a DC voltage pulse, frequency proportional, to a flow signal conditioner 102 which, in turn, transforms the signal received into a 4 to 20 mA signal proportional to flow. A 4 mA signal corresponds to a minimum acceptable flow through the system 66 (approximately 0.2 gallons per minute), and a 20 mA signal corresponds to the maximum flow possible through the system. The flow signal is relayed to a minimum flow interlock 104 forming a portion of the on/off switch means 14, and the signal mixer 100.

A preferred signal mixer 100 is Model AUL-2, manufactured by ATHENA CONTROLS, INC., of Plymouth Meeting, Pa. The flow signal conditioner 102 and the minimum flow interlock 104 are preferably similar, respectively, to Model Nos. MK514 and MK510, manufactured by SIGNET SCIENTIFIC of El Monte, Calif.

The signal mixer 100 is preprogrammed to permit heating of fluid within the system 66 to any temperature below the appropriate curve illustrated in FIG. 6 representing the system in use. Thus, while the signal mixer 100 will allow a ninety watt heating system 66 to be set at any fluid temperature between ambient temperature (20° C.) and a pre-set maximum acceptable temperature (96° C.), it will not permit the fluid temperature to rise above that pre-set limit even if the adjustable temperature controller 92 is set above that limit. This is accomplished by the signal mixer 100 permitting the signal from the temperature controller 92 to directly control the voltage control switch 98 in most circumstances, but when the flow decreases to a point where, unrestrained, the heating system 66 could heat the fluid above the pre-set limit, the signal from the flow signal conditioner 102 will be caused to override that from the temperature controller.

The microprocessor means 18 further includes a signal converter and amplifier 106, which transforms the signal received from the signal mixer 100, to a signal suitable for controlling the solid state relay 98. A preferred signal converter and amplifier 106 is Model 90-6, manufactured by ATHENA CONTROLS, INC. of Plymouth Meeting, Pa.

As is further evident from FIG. 7, the on/off switch means 14 includes, in addition to the minimum flow interlock 104, a switch 108 activated by the tip-over sensor 78, a liquid level relay 110 activated by a liquid level controller 112 responsive to the level sensor 48, a high-temperature relay 114 activated by a high-temperature limit controller 116 responsive to the over-temperature thermocouples 82, and a process over-temperature relay 118 responsive through the temperature controller 92 to the process thermocouple 46. The liquid level controller 112 is preferably similar to Model No. Levelite_531 S, manufactured by GENELCO of Dallas, Tex. The high-temperature limit controller 116 is preferably similar to Model Series 86, manufactured by ATHENA CONTROLS, INC., of Plymouth Meeting, Pa.

In order to more fully understand the control and safety system 12, the operation of the system in connection with a sixty watt water heating system 66 (see curve 88 in FIG. 6) will be described. Prior to initiation of fluid flow through the heating system 66, the minimum flow interlock 104 will be opened (thus preventing power from reaching the fluid heaters 10 and 10', the tip-over switch 108 will be closed, the liquid level relay 110 will be open, the high-temperature relay 114 will be closed, and the process over-temperature relay 118 will also be closed. Further, the solid state relay 98 will also typically be closed. The adjustable temperature controller 92 will be set at a desired temperature, for example 90° C., and then flow will be initiated through the heating system inlet 72.

Upon initiation of fluid flow, the fluid flow sensor 80 detects the flow and sends a DC voltage pulse, frequency proportional, to the flow signal conditioner 102. This flow signal conditioner 102 transforms the signal received into a 4 to 20 mA signal proportional to flow, and relays that transformed signal to the minimum flow interlock 104 and the signal mixer 100. Once a minimum acceptable flow is detected by the flow sensor 80, the minimum flow interlock 104 can be reset or closed to permit voltage flow therethrough. The liquid level relay 110, which is also initially opened to prevent voltage flow therethrough, can also be reset once the level sensor 48 on the master fluid heater 10' detects a sufficient fluid level therein.

When all relays and switches of the on/off switch means 14 are closed, the power from the power source 16 begins to heat the resistance heating elements 40 within the heating units 10 and 10'. The fluid passing through the heating system 66 can then be heated to the temperature indicated on the temperature controller 92 (90° C.). This is accomplished by means of the signal mixer 100 receiving input, indirectly, from the process thermocouple 46 and the level sensor 48. As discussed previously, under usual circumstances the signal from the process thermocouple 46 controls the solid state relay 98. If, however, the fluid flow decreases to a point where full power from the power source 16 would cause heating of the fluid temperature above the pre-set maximum limit, the signal mixer 100 will override the input from the temperature controller 92 with input from the flow signal conditioner 102. This occurs in the 60 watt system at a flow of about three gallons per minute (see FIG. 6).

Thus, it should be apparent that the microprocessor means 18 provides a first level of heating system safety as it prevents the heating of fluid above a pre-set safety limit. The on/off switch means 14, on the other hand, provides secondary levels of safety directed more specifically to particular components or conditions with respect to the heating system 66. In particular, the minimum flow interlock 104 will cut power to the fluid heaters 10 and 10' if insufficient flow is detected. Likewise, the tip-over switch 108 will cut off power if the normal orientation of the heating system 66 is upset. Similarly, the liquid level relay 110 cuts off power if an insufficient fluid level is detected in the master fluid heater 10'. The high-temperature limit relay 114 cuts off power to the fluid heaters 10 and 1040 if the temperature detected by an over-temperature thermocouple exceeds a predetermined limit. This safety is intended to prevent melt down of an environmental seal and contamination of the de-ionized fluid. The process over-temperature relay 118 cuts off power if the temperature of the heated fluid as detected by the process thermocouple 46 exceeds the pre-set safety limit. This process over-temperature relay provides a backup safety to the microprocessor means 18 to prevent a runaway heating condition which would damage the heating system, its components and probably contaminate the de-ionized fluid being heated.

From the foregoing it should be understood that the heating system 66 has the capability of effectively heating contaminant-free fluids in an effective and safe manner for a prolonged period of time. The specific construction of the heater body 20 and its interior components ensure uniform flow of fluid (as indicated by the arrows in FIG. 2) past the resistance heating element 40, and the control and safety system 12 provides a nearly fail safe system for ensuring the heating of fluids only within a specified range of temperatures. Moreover, it should be apparent that the necessary wiring for electrical interconnection of the components comprising the control and safety system 12, and assembly thereof, is well within the skill of persons acquainted with the relevant art.

Although a particular embodiment of the invention has been described in detail for purposes of illustration, various modifications may be made without departing from the spirit and scope of the invention. Accordingly, the invention is not to be limited, except as by the appended claims.

I claim:

1. A non-contaminating fluid heating system, comprising:

a system fluid inlet;

a system fluid outlet;

pressure regulator means for controlling the pressure of the fluid entering the system through the system fluid inlet;

a master heater unit including a master heater body having an upper end and a lower end, a master fluid inlet through the upper end of the master heater body, a master fluid outlet situated generally adjacent the master fluid inlet and communicating with the system fluid outlet, means for channelling fluid received into the master heater body through the master inlet centrally through the master heater body to a point generally adjacent the lower end of the master heater body, and a resistance heating element helically wound about the channeling means, the heating element having a jacket which is inert and corrosion-resistant to the fluid; and at least one slave heater unit including a slave heater body having an upper end and a lower end, a slave fluid inlet through the upper end of the slave heater body wherein the slave fluid inlet communicates with the system fluid inlet, a slave fluid outlet situated generally adjacent the slave fluid inlet wherein fluid exiting the slave fluid outlet is directed to the master fluid inlet, means for channelling fluid received into the slave heater body through the slave inlet centrally through the slave heater body to a point generally adjacent the lower end of the slave heater body, and a resistance heating element helically wound about the channelling means, the heating element having a jacket which is inert and corrosion-resistant to the fluid;

wherein all fluid contacting surfaces of the system are inert and corrosion-resistant to the fluid being heated, and wherein the heater units each include electrical ground means in contact with the heated fluid, the ground means including a ground wire having a jacket which is inert and corrosion-resistant to the fluid and having a tantalum tip, wherein only the tantalum tip is exposed to the fluid.

2. A heating system as set forth in claim 1, including a housing for the master heater unit and the at least one slave heater unit, wherein the system fluid inlet and the system fluid outlet are situated on the housing.

3. A heating system as set forth in claim 2, including a tip-over sensor positioned on the housing, wherein the tip-over sensor activates a separate tip-over switch to interrupt power to the resistance heating elements if the housing is tipped over.

4. A heating system as set forth in claim 1, wherein the heater bodies each form a fluid reservoir, and the fluid channelling means each include a tube the center of the respective heater body.

5. A heating system as set forth in claim 4, wherein the heater units each include a plenum planted for increasing turbulence of the fluid on its passage from an outlet of the respective tube to the respective heater body outlet.

6. A heating system as set forth in claim 1, including flow sensing means for detecting the flow of fluid into the slave fluid inlet.

7. A heating system as set forth in claim 6, including temperature sensing means for detecting the temperature of fluid passing from the master fluid outlet.

8. A heating system as set forth in claim 7, including fluid level sensing means for detecting a fluid level within the master heater unit.

9. A heating system as set forth in claim 1, wherein the jacket of the ground wire and the jacket of the resistance heating element are comprised of a Teflon material.

10. A fluid heating system, comprising:

a fluid heater powered by an external power source, which fluid heater has an inlet and an outlet, a fluid flow sensor for detecting the flow of fluid into the heater inlet, a level sensor for detecting a specified fluid level within the heater, and a thermocouple for detecting the temperature of the fluid exiting the heater outlet; and voltage control means for adjustably and selectively controlling the level of voltage flowing from the power source to the fluid heater, the voltage control means including an adjustable temperature controller which receives input from the thermocouple detecting the temperature of the fluid exiting the heater outlet, a flow signal conditioner which receives input from the fluid flow sensor, microprocessor means for comparing the flow of fluid into the heater and the temperature of the fluid exiting the heater, and a voltage control switch responsive to input from the microprocessor means, which voltage control switch controls the level of voltage flowing from the power source to the heater, the voltage control means limiting the maximum temperature of the fluid exiting the heater, wherein the microprocessor means includes a signal mixer which receives signals from the adjustable temperature controller and the flow signal conditioner, and a signal converter and amplifier which receives signals from the signal mixer and which, in turn, provides input signals to the voltage control switch, wherein the signal mixer permits the signal from the temperature controller to directly control the voltage control switch when the flow of fluid is sufficient to ensure that the heater will not heat the fluid above a preset limit, and wherein the signal mixer will override the signal from the temperature controller with the signal from the flow signal conditioner when the flow of fluid decreases to a point where, unrestrained, the heater could heat the fluid above the preset limit.

11. A fluid heating system as set forth in claim 10, including on/off switch means responsive to conditions within and affecting the fluid heater, which switch means is capable of interrupting the power supply from the power source to the fluid heater.

12. A fluid heating system as set forth in claim 11, wherein the on/off switch means includes a minimum flow interlock which interrupts the power supply from the power source to the heater if a minimum fluid flow is not detected by the fluid flow sensor.

13. A fluid heating system as set forth in claim 12, wherein the on/off switch means includes a tip-over switch which is responsive to a separate tip-over sensor, wherein the tip-over switch interrupts the power supply from the power source to the heater if the heater is tipped over.

14. A fluid heating system as set forth in claim 12, wherein the on/off switch means includes a minimum liquid level relay switch which interrupts the power supply from the power source to the heater if the specified fluid level is not detected by the level sensor.

15. A fluid heating system as set forth in claim 14, wherein the on/off switch means includes a process over-temperature relay switch which interrupts the power supply from the power source to the heater if the temperature of the fluid exiting the heater outlet exceeds a pre-set safety limit.

16. A fluid heating system as set forth in claim 17, wherein the on/off switch means includes heating element temperature sensing means for detecting the temperature of the heating element, and a high-temperature limit relay which interrupts the power supply from the power source to the heating element if the temperature detected by the heating element temperature sensing means approaches a pre-set level.

17. A fluid heater and control system, comprising;

a fluid heater including a heater body having a first end and a second end, a fluid inlet through the first end of the heater body, a fluid outlet through the first end of the heater body, means for channelling fluid received into the heater body through the inlet to a point generally adjacent the second end of the heater body, a resistance heating element wound about the channelling means, and means for connecting the heating element with an externally located power source, wherein the heater body forms a fluid reservoir and the fluid channelling means includes a tube extending from the inlet generally through the center of the heater body, and wherein the resistance heating element is helically wound substantially the length of the fluid channelling means, the heater and control system further including a plenum plate situated within the heater body to increase turbulence of the fluid on its passage from an outlet of the tube to the heater body outlet, and electrical ground means in contact with the heated liquid, wherein the plenum plate includes a plurality of apertures and is comprised of a material which is inert and corrosion-resistant to the fluid, and wherein the resistance heating element has a jacket which is inert and corrosion-resistant to the fluid;

on/off switch means responsive to conditions within and affecting the fluid heater, which switch means is capable of interrupting power supply form the power source to the heating element; and voltage control means for adjustably and selectively controlling the level of voltage flowing from the power source to the heating element, the voltage control means including means for sensing the flow of fluid into the heater and the temperature of fluid exiting the heater and, based on these two variables, limiting the maximum temperature of the fluid exiting the heater.

18. A fluid heater and control system, comprising:

a fluid heater including a heater body having a first end and a second end, a fluid inlet through the first end of the heater body, a fluid outlet through the first end of the heater body, means for channelling fluid received into the heater body through the inlet to a point generally adjacent the second end of the heater body, a resistance heating element wound about the channelling means, and means for connecting the heating element with an externally located power source;

on/off switch means responsive to conditions within and affecting the fluid heater, which switch means is capable of interrupting power supply from the power source to the heating element; and voltage control means for adjustably and selectively controlling the level of voltage flowing from the power source to the heating element, the voltage control means including means for sensing the flow of fluid into the heater and the temperature of fluid exiting the heater, microprocessor means for comparing the flow of fluid into the heater with the temperature of the fluid exiting the heater, and a voltage control switch responsive to input from the microprocessor means, which voltage control switch adjustably controls the level of voltage flowing from the power source to the heating element for limiting the maximum temperature of the fluid exiting the heater;

wherein the voltage control means includes an adjustable temperature controller which receives input from the means for sensing the temperature of fluid exiting the heater, and a flow signal conditioner which receives input from the means for sensing the flow of fluid, and wherein the microprocessor means includes a signal mixer which receives signals from the adjustable temperature controller and the flow signal conditioner, and a signal converter and amplifier which receives signals from the signal mixer and which, in turn, provides input signals to the voltage control switch, wherein the signal mixer permits the signal from the temperature controller to control the voltage control switch when the flow of fluid is sufficient to ensure that the heating element will not heat the fluid above a preset limit, and wherein the signal mixer will override the signal from the temperature controller with the signal from the flow signal conditioner when the flow of fluid decreases to a point where, unrestrained, the heating element could heat the fluid above the preset limit.

19. A fluid heating system, comprising:

at least one fluid heater powered by an external power source, the fluid heating system having an inlet and an outlet, a fluid flow sensor for detecting the flow of fluid into the system inlet, a level sensor for detecting a specified fluid level within the at least one fluid heater, and a thermocouple for detecting the temperature of the fluid exiting the system outlet;

on/off switch means responsive to conditions within and affecting the at least one fluid heater, which switch means is capable of interrupting the power supply from the power source to the at least one fluid heater; and voltage control means for adjustably and selectively controlling the level of voltage flowing from the power source to the at least one fluid heater, the voltage control means including microprocessor means for comparing the flow of fluid into the at least one fluid heater and the temperature of the fluid exiting the system, and a voltage control switch responsive to input from the microprocessor means, which voltage control switch controls the level of voltage flowing from the power source to the at least one fluid heater, the voltage control means limiting the maximum temperature of the fluid exiting the system, wherein the voltage control means includes an adjustable temperature controller which receives input from the thermocouple detecting the temperature of the fluid exiting the system outlet, and a flow signal conditioner which receives input from the fluid flow sensor, and wherein the microprocessor means includes a signal mixer which receives signals from the adjustable temperature controller and the flow signal conditional, and a signal converter and amplifier which receives signals from the signal mixer and, in turn, provides input signals to the voltage control switch, wherein the microprocessor means permits the signal from the temperature controller to control the voltage control switch when the flow of fluid is sufficient to ensure that the at least one fluid heater will not heat the fluid above a preset limit, and wherein the microprocessor means will override the signal from the temperature controller with a signal from the flow signal conditioner when the flow of fluid decreases to a point where, unrestrained, the at least one heater could heat the fluid above the preset limit.

20. A fluid heating system comprising:

a fluid heater having an inlet, an outlet, a resistance heating element, means for connecting the heating element with an externally located power source, a fluid flow sensor for detecting the flow of fluid into the heater inlet, a level sensor for detecting a specified fluid level within the heater, and means for detecting the temperature of the fluid exiting the heater outlet; and on/off switch means responsive to conditions within and affecting the fluid heater, which switch means is capable of interrupting the power supply from the power source to the fluid heater, the on/off switch means including:

a minimum flow interlock which interrupts the power supply form the power source to the heating element if a minimum fluid flow is not detected by the fluid sensor, the minimum flow interlock being indirectly responsive to the fluid flow sensor via a flow signal conditioner;

as tip-over switch which interrupts the power supply from the power source to the heater if the heater is tipped over, the tip-over switch being activated by a tip-over sensor;

a minimum liquid level relay switch which interrupts the power supply from the power source to the heater if the specified fluid level is not detected by the level sensor, the liquid level relay switch being indirectly responsive to the level sensor via a liquid level controller;

a thermocouple for detecting the temperature of the heating element;

a high-temperature limit relay which interrupts the power supply from the power source to the heating element if the temperature detected by the thermocouple approaches a preset level, the high-temperature limit relay being indirectly responsive to the thermocouple via a high-temperature limit controller ;

a process over-temperature relay switch which interrupts the power supply from the power source to the heating element if the means for detecting the temperature of the fluid exiting the heater outlet detects a fluid temperature which exceeds a preset limit, the over-temperature relay switch being indirectly responsive to the temperature detecting means via an adjustable temperature controller; and voltage control means for adjustably and selectively controlling the level of voltage flowing from the power source to the heating element, the voltage control means including microprocessor means for comparing the flow of fluid into the heater and the temperature of the fluid exiting the heater, and a voltage control switch responsive to input from the microprocessor means, which voltage control switch controls the level of voltage flowing from the power source to the heater, the voltage control means limiting the maximum temperature of the fluid exiting the heater, wherein the microprocessor means includes a signal mixer which receives signals form the adjustable temperature controller and the flow signal conditioner, and a signal converter and amplifier which receives signals from the signal mixer and which, in turn, provides input signals to the voltage control switch, wherein the signal mixer permits the signal from the temperature controller to directly control the voltage control switch when the flow of fluid is sufficient to ensure that the heater will not heat the fluid above a preset limit, and wherein the signal mixer will override the signal from the temperature controller with the signal from the flow signal conditioner when the flow of fluid decreases to a point where, unrestrained, the heater could heat the fluid above the preset limit.

21. A non-containminating fluid heating system, comprising:

a system fluid inlet;

a system fluid outlet;

pressure regulator means for controlling the pressure of the fluid entering the system through the system fluid inlet;

a master heater unit including a master heater body having an upper end and a lower end, a master fluid inlet through the upper end of the master heater body, a master fluid outlet situated generally adjacent the master fluid inlet and communicating with the system fluid outlet, means for channelling fluid received into the master heater body through the master inlet centrally through the master heater body to a point generally adjacent the lower end of the master heater body, and a resistance heating element helically wound about the channelling means, the heating element having a jacket which is inert and corrosion resistant to the fluid; and at least one slave heater unit including a slave heater body having an upper end and a lower end, a slave fluid inlet through the upper end of the slave heater body wherein the slave fluid inlet communicates with the system fluid inlet, a slave fluid outlet situated generally adjacent the slave fluid inlet wherein fluid exiting the slave fluid outlet is directed to the master fluid inlet, means for channelling fluid received into the slave heater body through the slave inlet centrally through the slave heater body to a point generally adjacent the lower end of the slave heater body, and a resistance heating element helically wound about the channelling means, the heating element having a jacket which is inert and corrosion-resistant to the fluid;

wherein all fluid contacting surfaces of the system are inert and corrosion-resistant to the fluid being heated and wherein the heater units each include electrical ground means in contact with the heated fluid, the ground means including a ground wire having a jacket which is inert and corrosion-resistant to the fluid and having a platinum tip, wherein only the platinum tip is exposed to the fluid.

* * * * *

UNITED STATES PATENT AND TRADEMARK OFFICE

CERTIFICATE OF CORRECTION

PATENT NO. : 4,835,365

DATED : May 30, 1989

INVENTOR(S) : David R. Etheridge

It is certified that error appears in the above-identified patent and that said Letters Patent is hereby corrected as shown below:

In the Abstract, line 3, insert --,-- between "inlet" and "an".

In the Abstract, line 6, insert --,-- between "tube" and "and".

In the Abstract, line 14, insert the word --a-- between "," and "high".

In Column 1, line 7, insert the word --and-- after "1986".

In Column 1, line 60, delete ",".

In Column 2, line 63, delete the word "would" and insert therefor --wound--.

In Column 4, line 24, insert the word --heating-- between "fluid" and "system".

In Column 5, line 23, insert --access tubes-- between "fourth" and "42".

UNITED STATES PATENT AND TRADEMARK OFFICE

CERTIFICATE OF CORRECTION

DATED : May 30, 1989

INVENTOR(S) : David R. Etheridge

It is certified that error appears in the above-identified patent and that said Letters Patent is hereby corrected as shown below:

In Column 8, line 11, delete the word "resistant" and insert therefor --resistance heating--.

In Column 8, line 14, insert the word --plurality-- between "a" and "of".

In Column 8, line 16, delete the word "heaters" after the word "the", and insert the word --heaters-- between "of" and "10".

In Column 8, line 30, insert the word --the-- between "controls" and "level".

In Column 9, line 44, insert --)-- between "10'" and ",".

In Column 10, line 32, delete "1040" and insert therefor --10'--.

In Column 11, line 53, insert --extending from the respective inlet generally through-- between "tube" and "the".

UNITED STATES PATENT AND TRADEMARK OFFICE

CERTIFICATE OF CORRECTION

PATENT NO. : 4,835,365

DATED : May 30, 1989

INVENTOR(S) : David R. Etheridge

It is certified that error appears in the above-identified patent and that said Letters Patent is hereby corrected as shown below:

In Column 11, line 56, delete the word "planted" and insert therefor --plate--.

In Column 13, line 4, delete "17" and insert therefor --15--.

In Column 13, line 12, delete ";" and insert therefor --:--.

In Column 13, line 41, delete the word "form" and insert therefor --from--.

In Column 15, line 1, delete the word "conditional" and insert therefor --conditioner--.

In Column 15, line 30, delete the word "form" and insert therefor --from--.

In Column 15, line 32, insert the word --flow-- between "fluid" and "sensor".

In Column 15, line 35, delete the word "as" and insert therefor --a--.

UNITED STATES PATENT AND TRADEMARK OFFICE

CERTIFICATE OF CORRECTION

PATENT NO. : 4,835,365

DATED : May 30, 1989

INVENTOR(S) : David R. Etheridge

It is certified that error appears in the above-identified patent and that said Letters Patent is hereby corrected as shown below:

In Column 16, line 9, delete the word "form" and insert therefor --from--.

In Column 16, line 24, delete the word "non-containminating" and insert therefor --non-contaminating--.

Signed and Sealed this

Eighth Day of May, 1990

*Attest:*

HARRY F. MANBECK, JR.

*Attesting Officer*

*Commissioner of Patents and Trademarks*